US007299774B2

(12) United States Patent
Lechner et al.

(10) Patent No.: US 7,299,774 B2
(45) Date of Patent: Nov. 27, 2007

(54) VALVE CONTROL

(75) Inventors: Martin Lechner, Stuttgart (DE); Falk Schneider, Münchingen (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 53 days.

(21) Appl. No.: 10/513,358

(22) PCT Filed: Jan. 21, 2004

(86) PCT No.: PCT/DE2004/000079

§ 371 (c)(1),
(2), (4) Date: Nov. 2, 2004

(87) PCT Pub. No.: WO2004/067922

PCT Pub. Date: Aug. 12, 2004

(65) Prior Publication Data

US 2005/0211202 A1 Sep. 29, 2005

(30) Foreign Application Priority Data

Jan. 30, 2003 (DE) ..... 103 03 601

(51) Int. Cl.
*F01L 1/34* (2006.01)

(52) U.S. Cl. ..... 123/90.16; 123/90.44; 74/569

(58) Field of Classification Search ..... 123/90.15, 123/90.16, 90.17, 90.18, 90.27, 90.31, 90.39, 123/90.44, 90.2, 90.41; 74/569, 567, 559
See application file for complete search history.

(56) References Cited

U.S. PATENT DOCUMENTS 5,052,350 A 10/1991 King
5,178,105 A 1/1993 Norris
5,642,692 A * 7/1997 Wride ..... 123/90.16

FOREIGN PATENT DOCUMENTS

| | | |
|---|---|---|
| DE | 119 741 | 10/1899 |
| DE | 3531000 | 8/1986 |
| DE | 196 00 536 | 7/1997 |
| DE | 197 01 201 | 7/1998 |
| DE | 198 02 738 | 7/1999 |
| DE | 199 20 512 | 11/2000 |
| EP | 0 472 430 | 2/1992 |
| EP | 1 022 443 | 7/2000 |
| GB | 170877 | 5/1920 |
| GB | 654240 | 6/1951 |
| GB | 2180597 | 4/1987 |

OTHER PUBLICATIONS

Patent Abstracts of Japan vol. 1996, No. 09, Sep. 30, 1996 & JP 08 13542 A May 28, 1996 abstract (Intl. Srch. Rep.).

* cited by examiner

*Primary Examiner*—Ching Chang
(74) *Attorney, Agent, or Firm*—Collard & Roe, P.C.

(57) ABSTRACT

The invention relates to a valve control for actuating at least one valve, especially an inlet or outlet valve of an internal combustion engine, wherein the dimension of the valve lift of the at least one valve corresponds to a superposition of two cam profiles which can be adjusted in phases in relation to each other and are displaced synchronously. The aim of the invention is to improve the construction and functioning of the valve control. As a result, a guiding means between an intermediate element and the first cam profile is embodied as third cam profile which is formed in a complementary manner with respect to the first cam profile and rotates in a synchronous manner therewith.

13 Claims, 14 Drawing Sheets

VALVE CONTROL

CROSS REFERENCE TO RELATED APPLICATIONS

Figure 1:
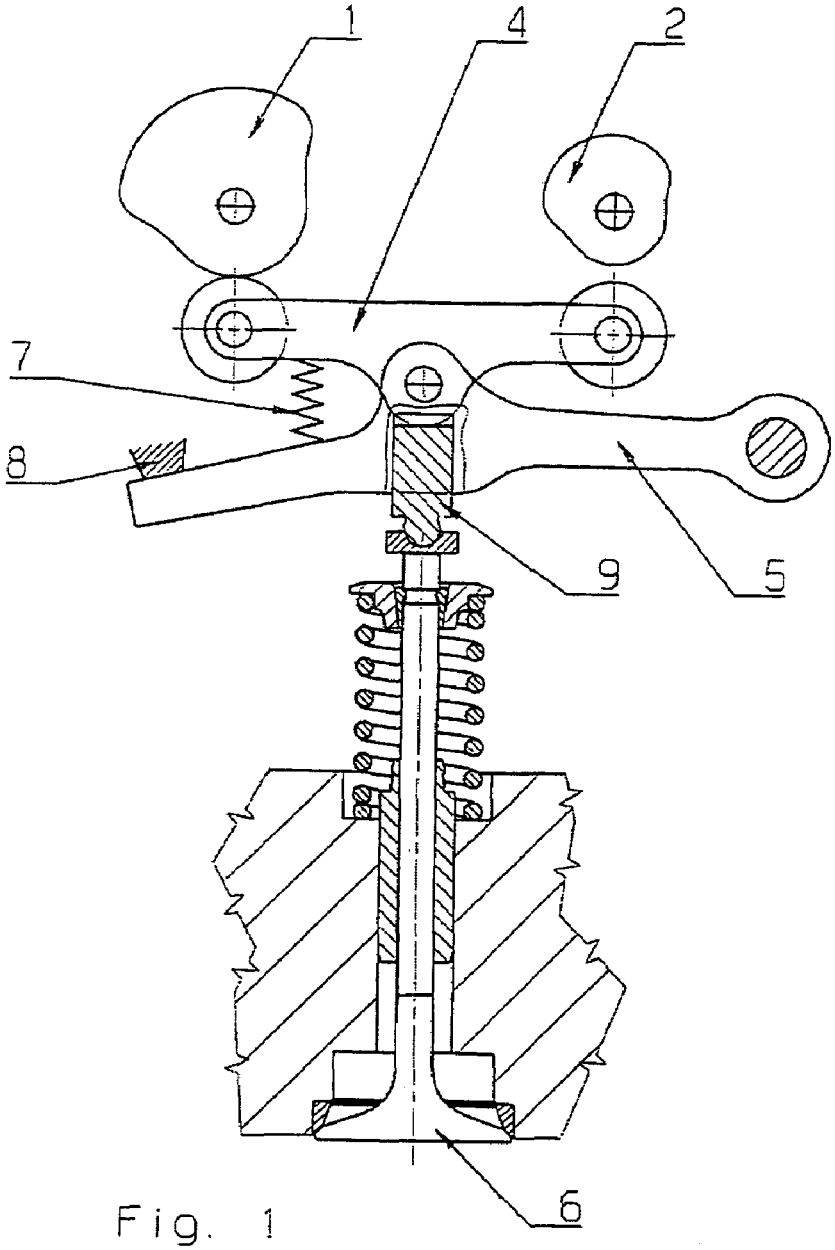
Fig. 1 PRIOR ART

Applicants claim priority under 35 U.S.C. §119 of German Application No. 10303601.6, filed Jan. 30, 2003. Applicants also claim priority of the present application which is a continuation of the 35 USC 371 national stage of International Application of PCT/DE2004/00079 filed on Jan. 21, 2004, which designed the United States of America. The international application under PCT article 21(2) was not published in English.

This invention relates to a valve control for actuating at least one valve, in particular an intake valve or an exhaust valve of an internal combustion engine.

Such valve controls are essentially known from German Patent DE 119741, British Patent GB 170877, British Patent GB 654240, German Patent DE 3531000 A1 and British Patent GB 2180597 A, for example. With such controls, valve lift is achieved only when the intermediate element is actuated by both cam profiles. The resulting valve lift corresponds to the total function of the two cam profiles. The opening duration and the valve lift may be altered by mutual phase displacement of the cams.

The manner in which the valve lift and the opening duration of such controls are adjustable can be determined quite well from British Patent GB 2180587 A, for example. One particular disadvantage of these embodiments is that in the times without valve lift in contrast with the standard valve lift, there is a very great play between the intermediate element and a cam profile and/or between the valve and the actuating element, this play normally corresponding to the valve lift of a cam.

Due to this play, a stop must be provided to limit the freedom of movement of the lift actuating element to ensure the required clearance (play) for a cam profile, which may be the closing cam profile, for example, when using an automatic play compensation element. On the other hand, an attempt may be made through suitable means to keep the two cam profiles always engaged with the intermediate lever, as is the case with an embodiment according to British Patent GB 2180597 A, for example, where the play between the lift actuating element and the intermediate element must be bridged with each movement. In such systems, a force such as a spring force is always necessary to rule out indefinite intermediate positions of the lift actuating element. Corresponding embodiments are depicted in German Patent DE 19802738 A1 and European Patent EP 1022443 B1.

Due to the arrangement of a stop, as depicted in the device according to German Patent DE 19802738 A1, for example, it is possible to implement a stop for the movement of the lift actuating element with the intermediate element without an additional device arranged in a stationary manner in the cylinder head, and to do so by supporting the intermediate lever on the camshaft via a supporting contour mounted concentrically with the axis of movement. It is also possible to use a conventional hydraulic play compensation element here.

U.S. Pat. No. 5,178,105 describes an attempt to create an arrangement without any play, whereby the two cam profiles are designed with very long, diametrically opposed ramps to thereby permit operation without play in the adjustment range. Because of the geometric boundary conditions, however, the adjustment range is relatively limited, so that valve lift actuation is impossible for a throttle-free valve control in an internal combustion engine.

This invention is concerned with the problem of improving upon the disadvantages described above, namely great play, difficult automatic compensation of play and the need for a pressing force in the direction of a cam profile on the one hand or a very restricted adjustment range on the other hand, while at the same time creating a generic valve control with which a "throttle-free load control" is possible with no problem in an internal combustion engine of a motor vehicle in particular.

The inventive solution to this problem complex involves a generic valve control according to the invention.

Advantageous and expedient embodiments of this invention are the object of the subclaims. This invention is based on the general idea of preferably pressure-free forced guidance of the guide area of the intermediate element, which should contact one of the two cam profiles without lifting and to use an additional moving cam profile for this purpose.

In an embodiment according to the invention, in which all the cam profiles, i.e., a total of three cam profiles, are arranged concentrically on a basic circle on an adjusting camshaft, no additional stop for the intermediate element is necessary when using a conventional hydraulic valve play compensation element. The intermediate element is instead clamped continuously without play between the cam profiles on the one hand and the lift actuating element on the other hand.

Figure 2:
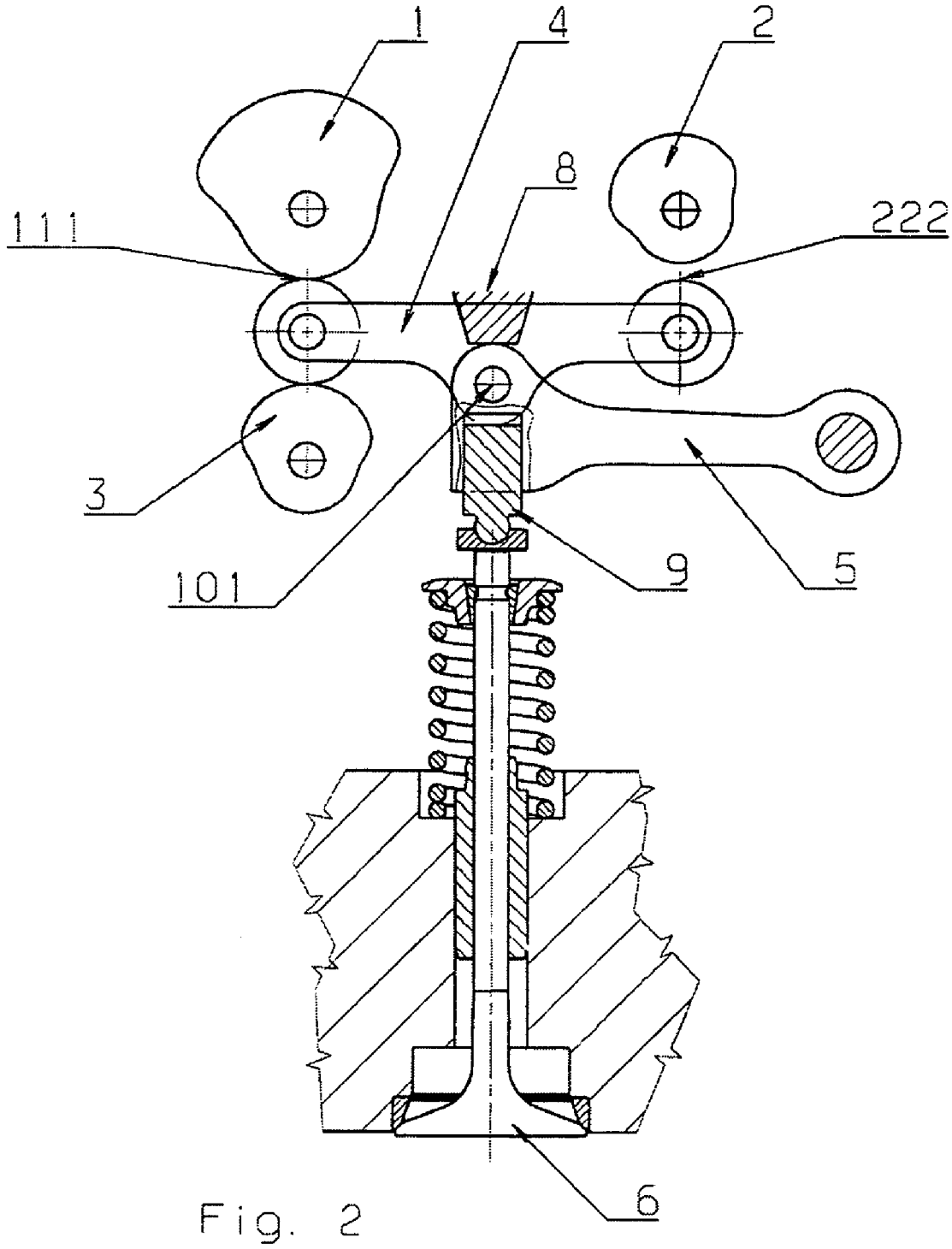
Figure 2A:
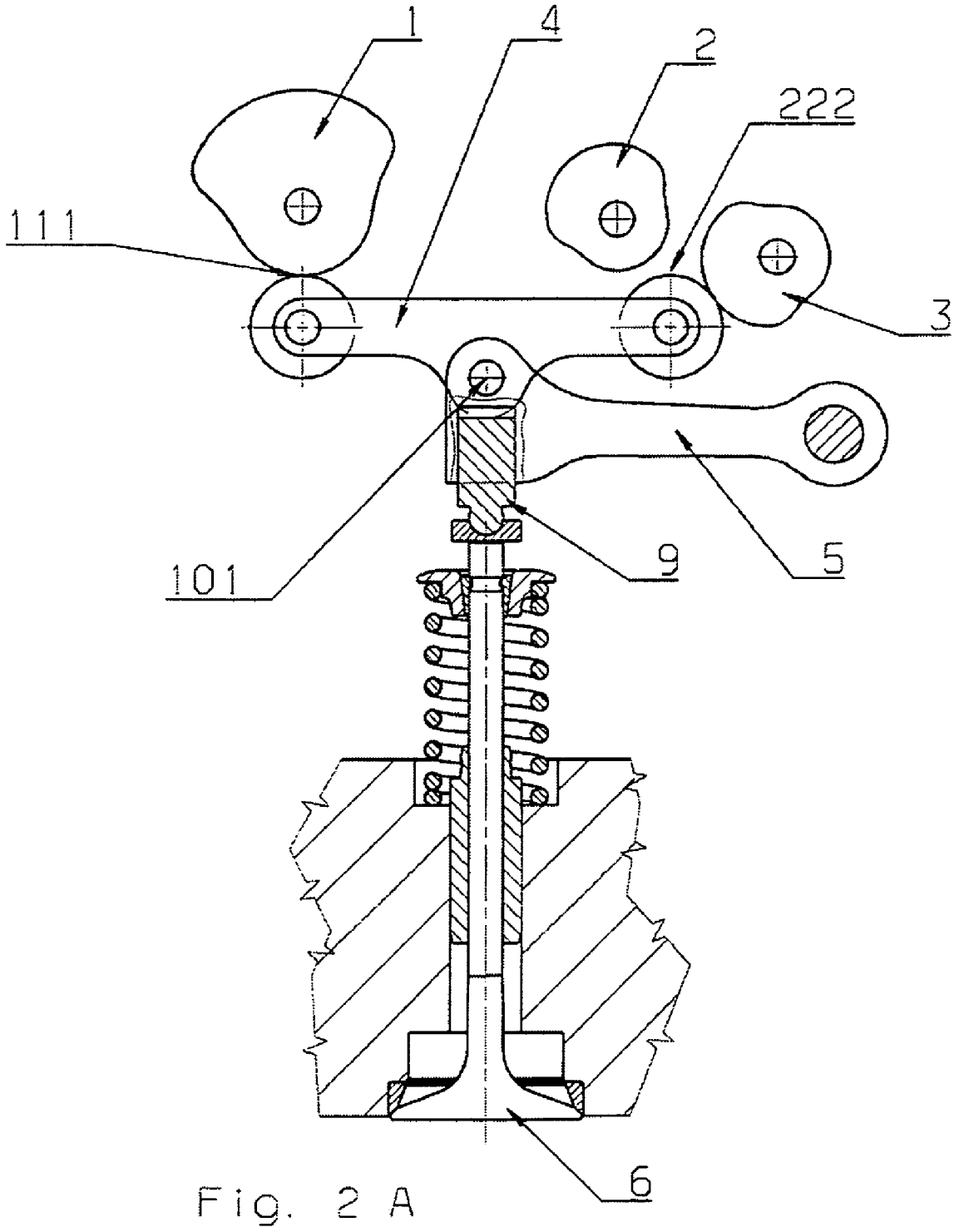
Figure 3:
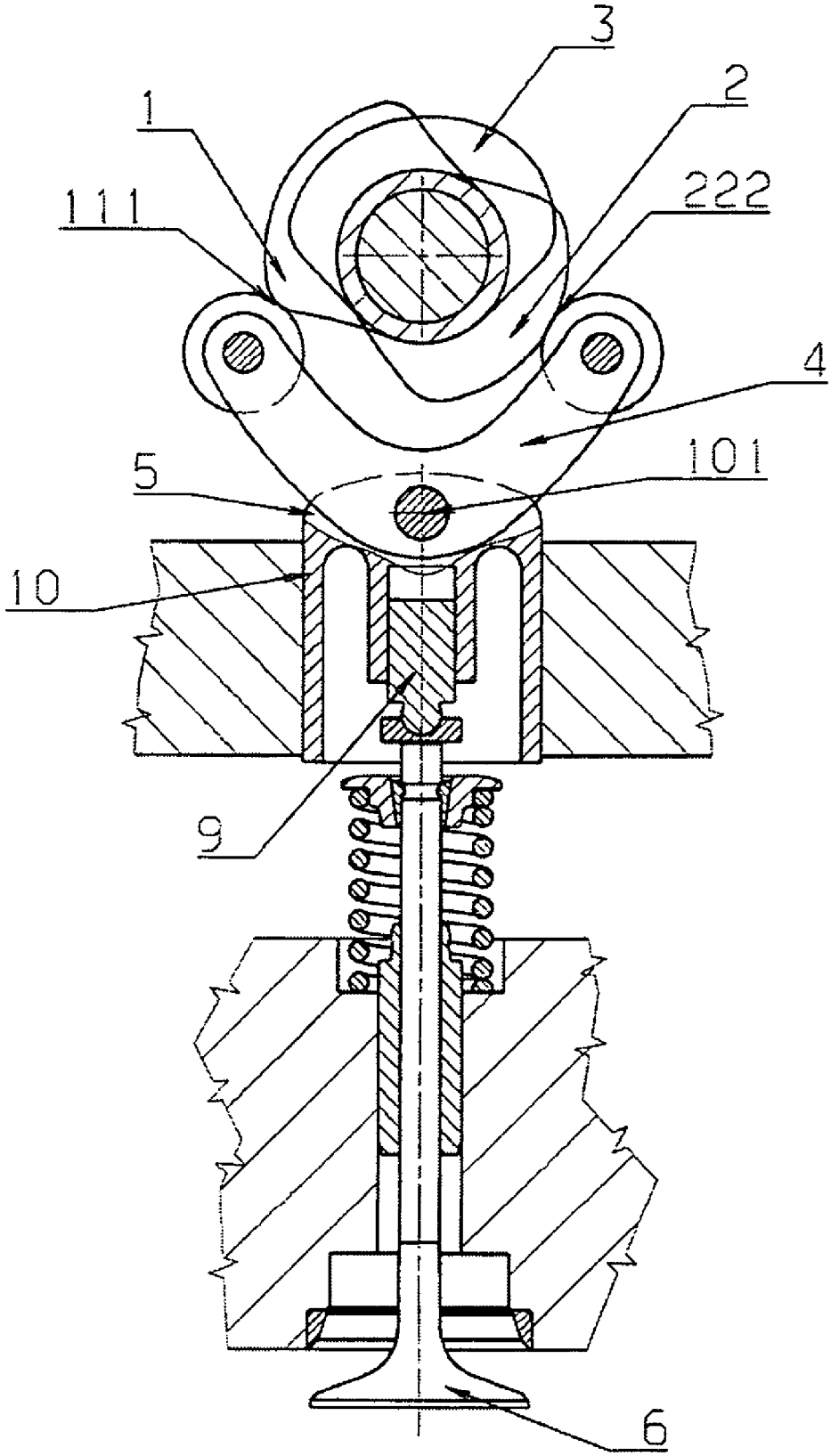
Figure 4:
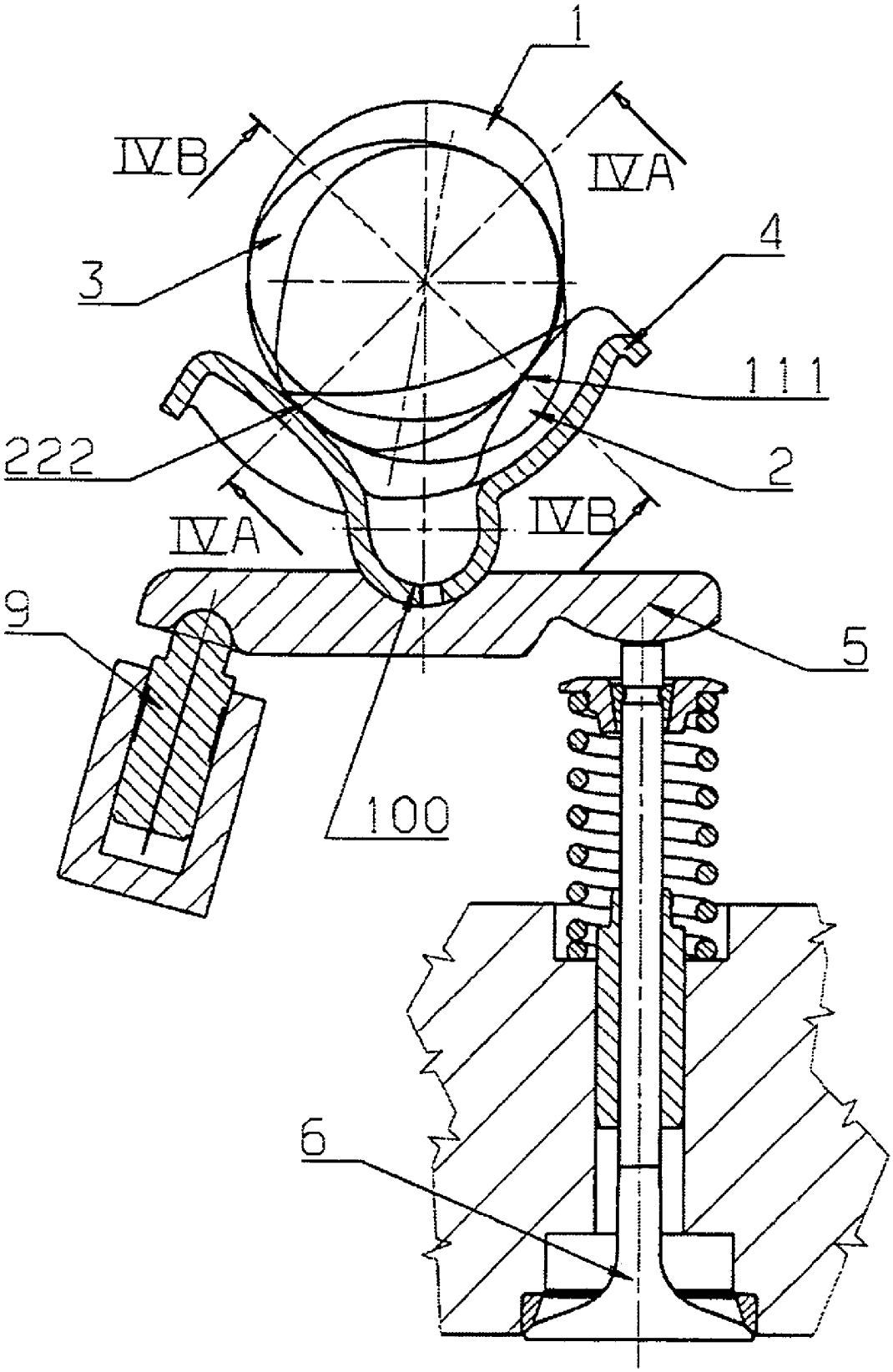
Figure 4A:
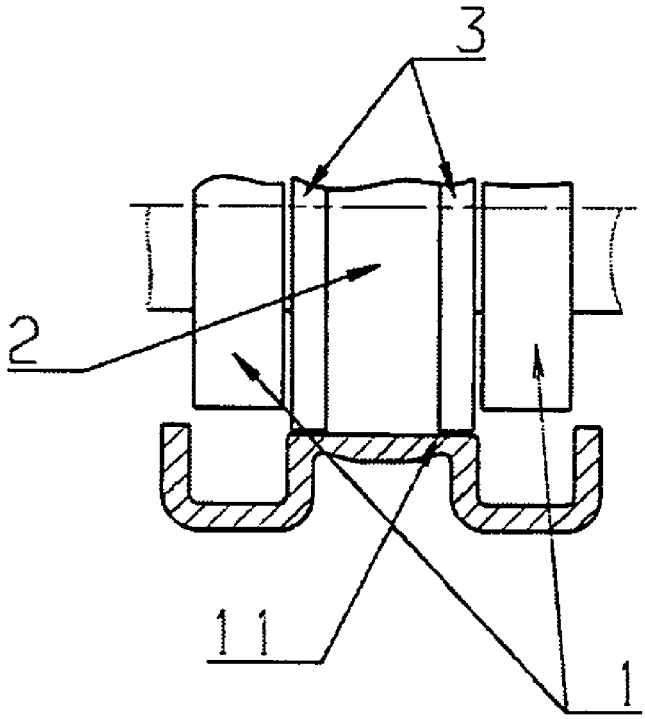
Figure 4B:
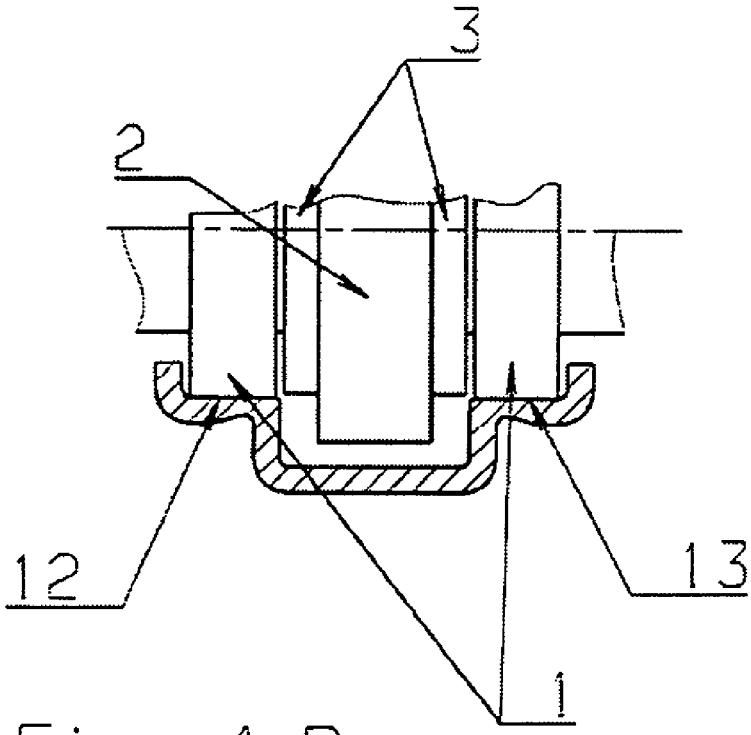
Figure 5:
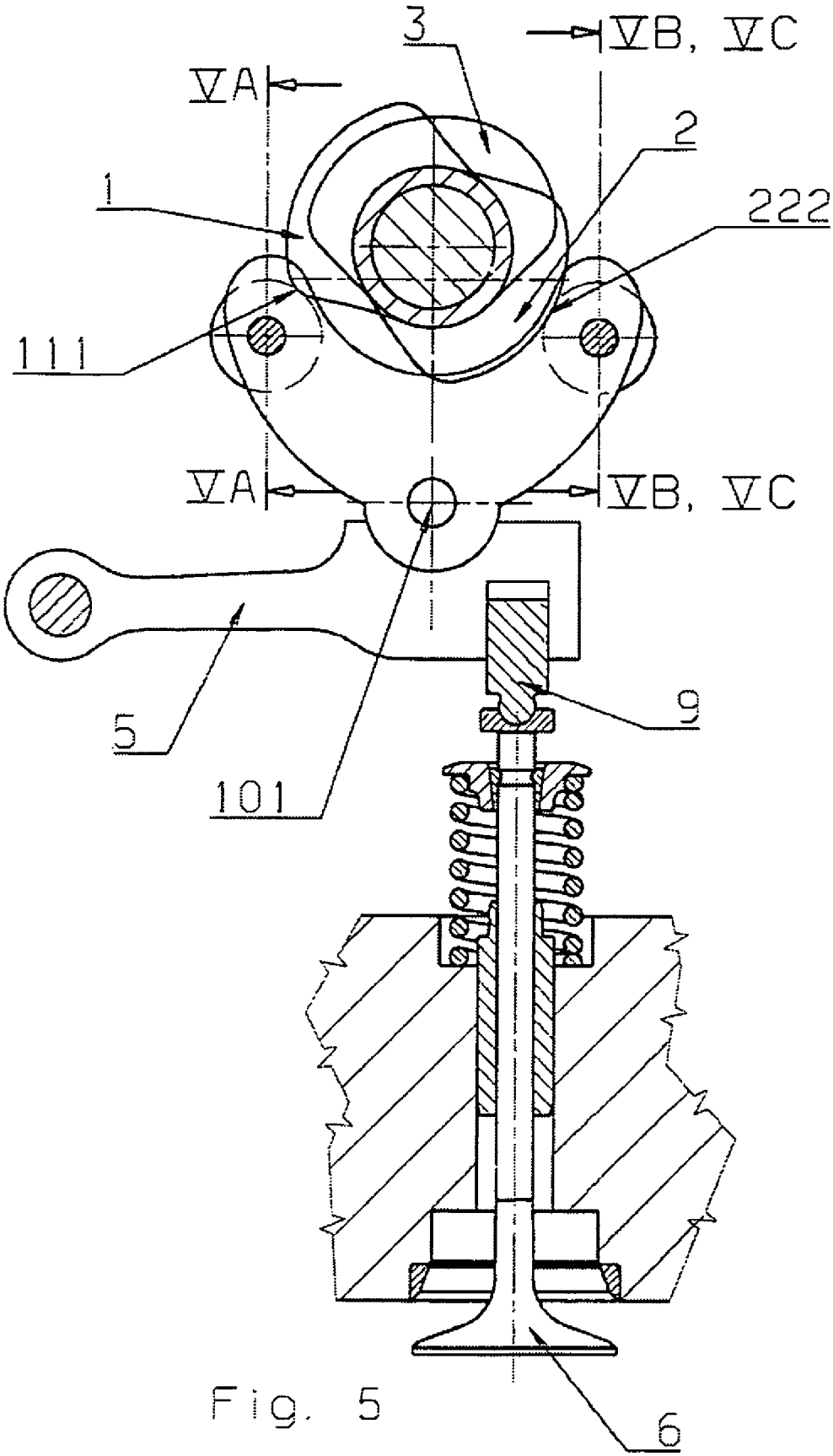
Figure 5A:
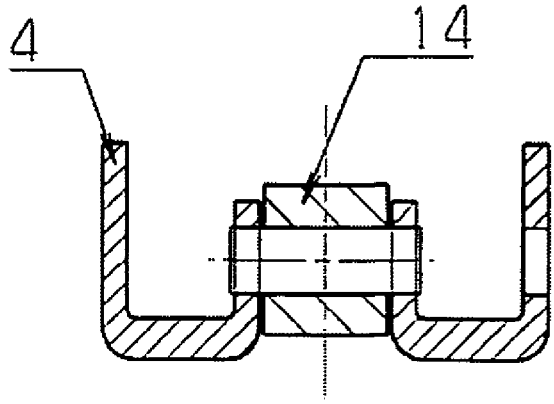
Figure 5B:
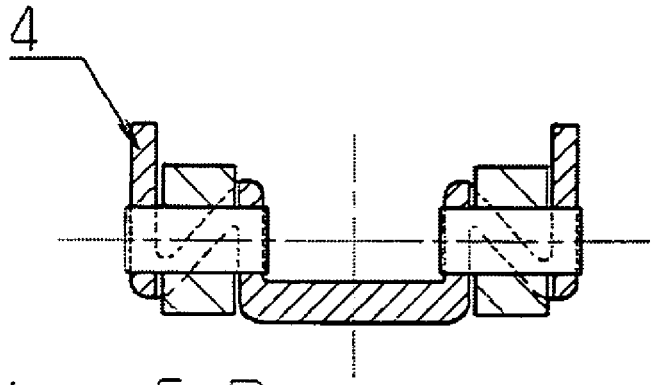
Figure 5C:
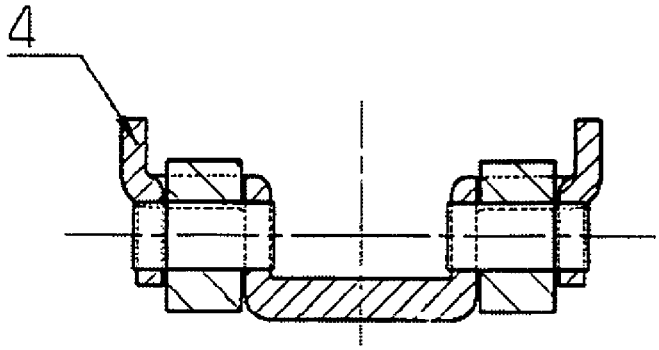
Figure 6:
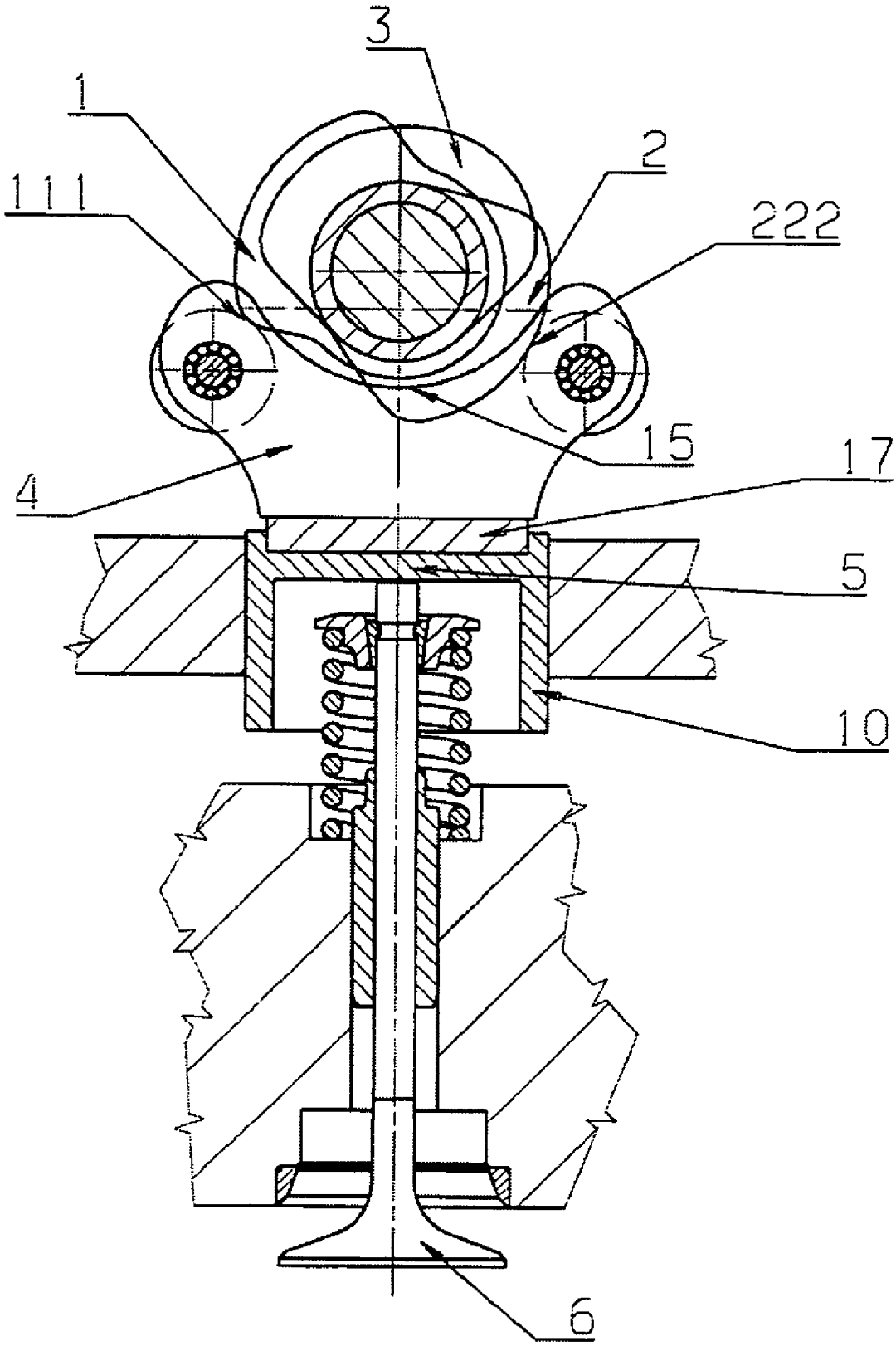
Figure 7:
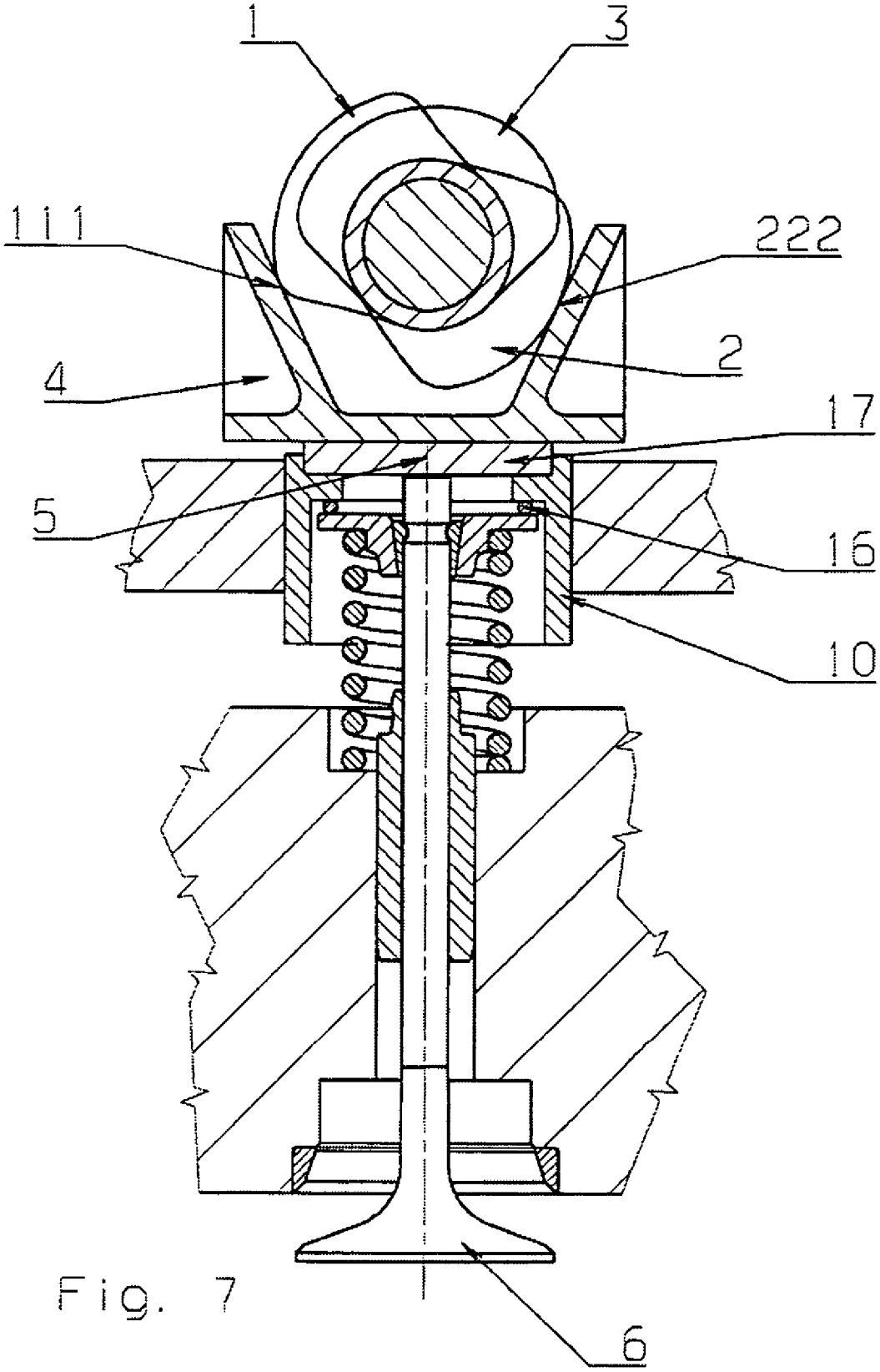
Figure 8:
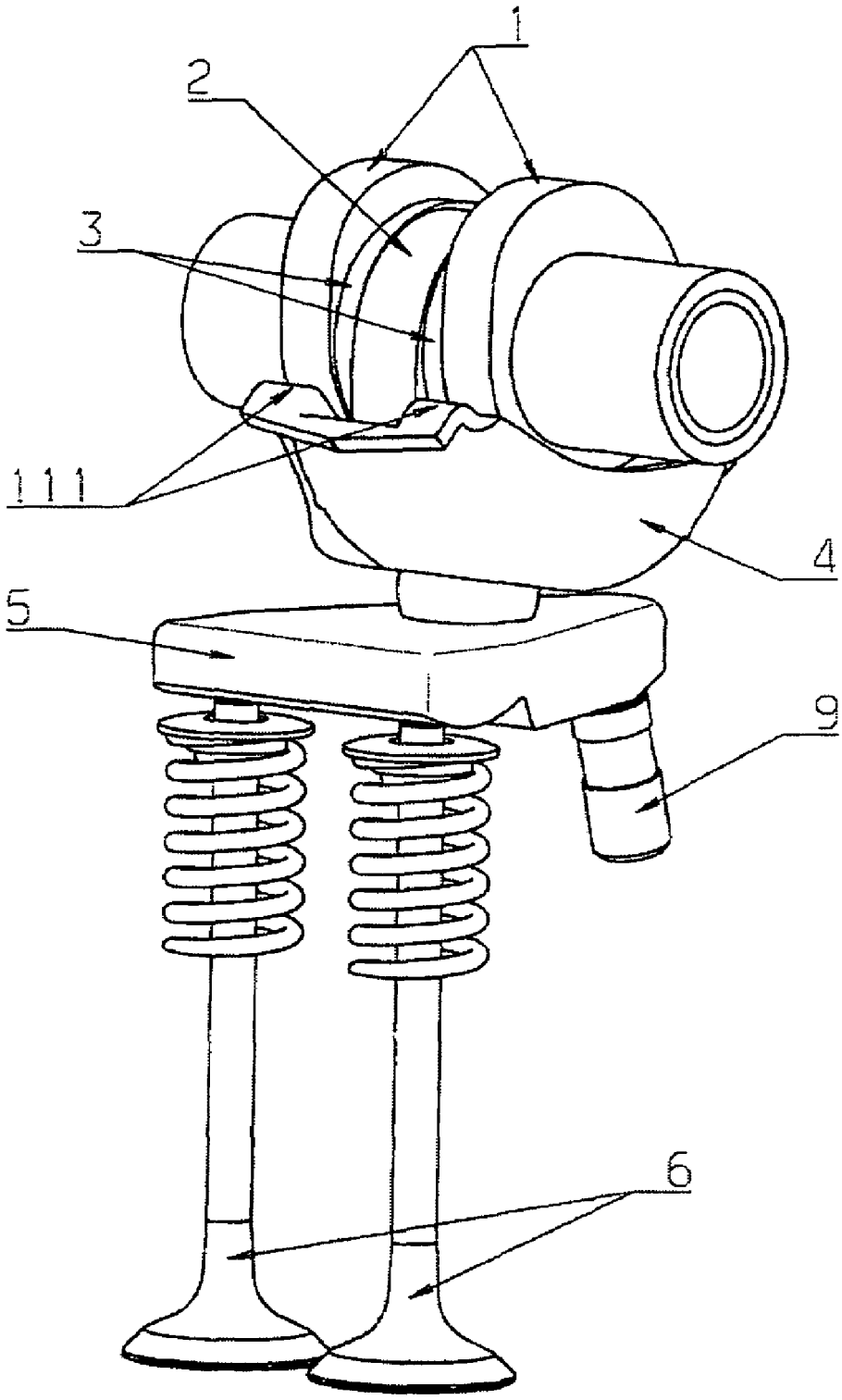
Figure 9:
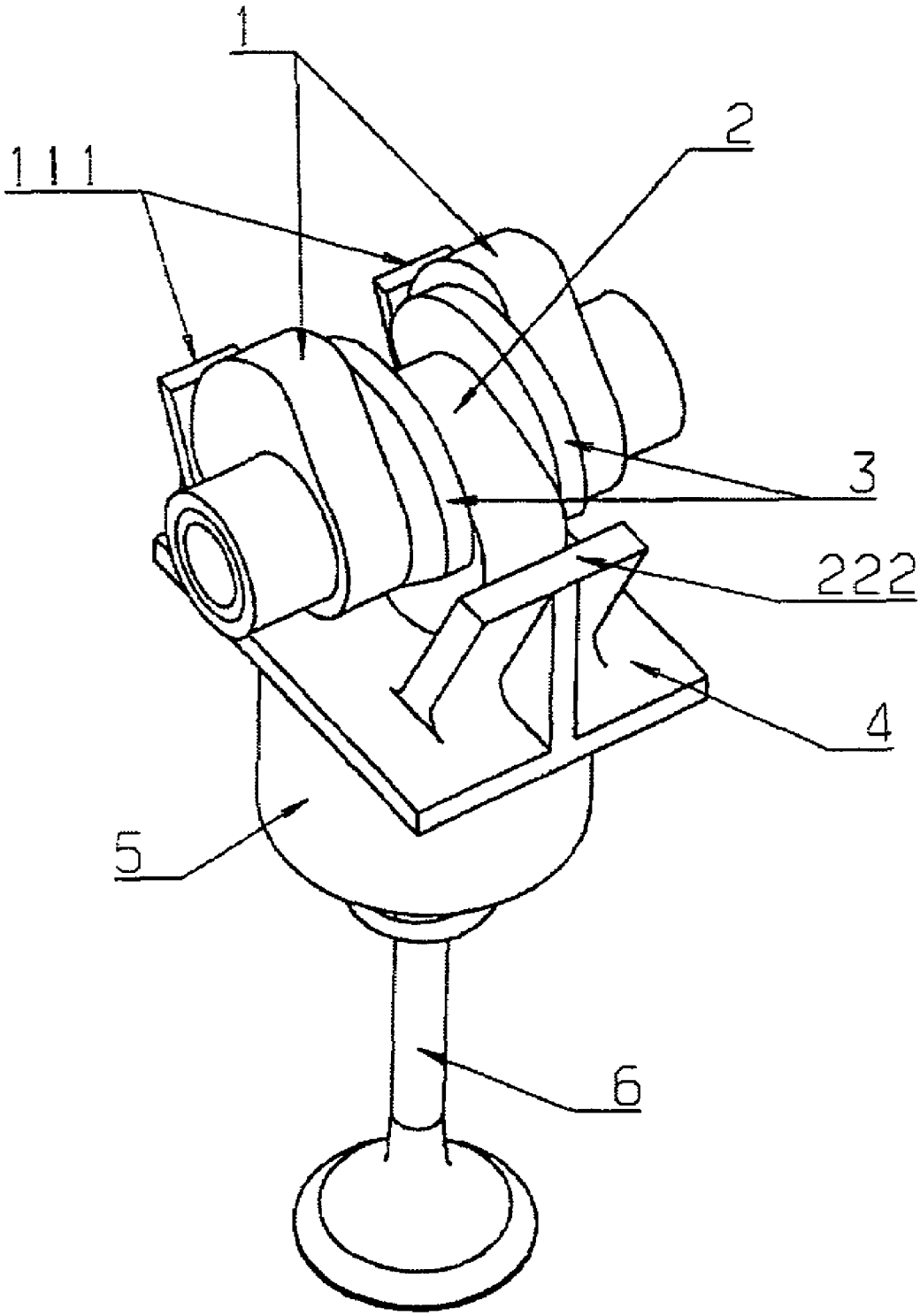
Figure 10:
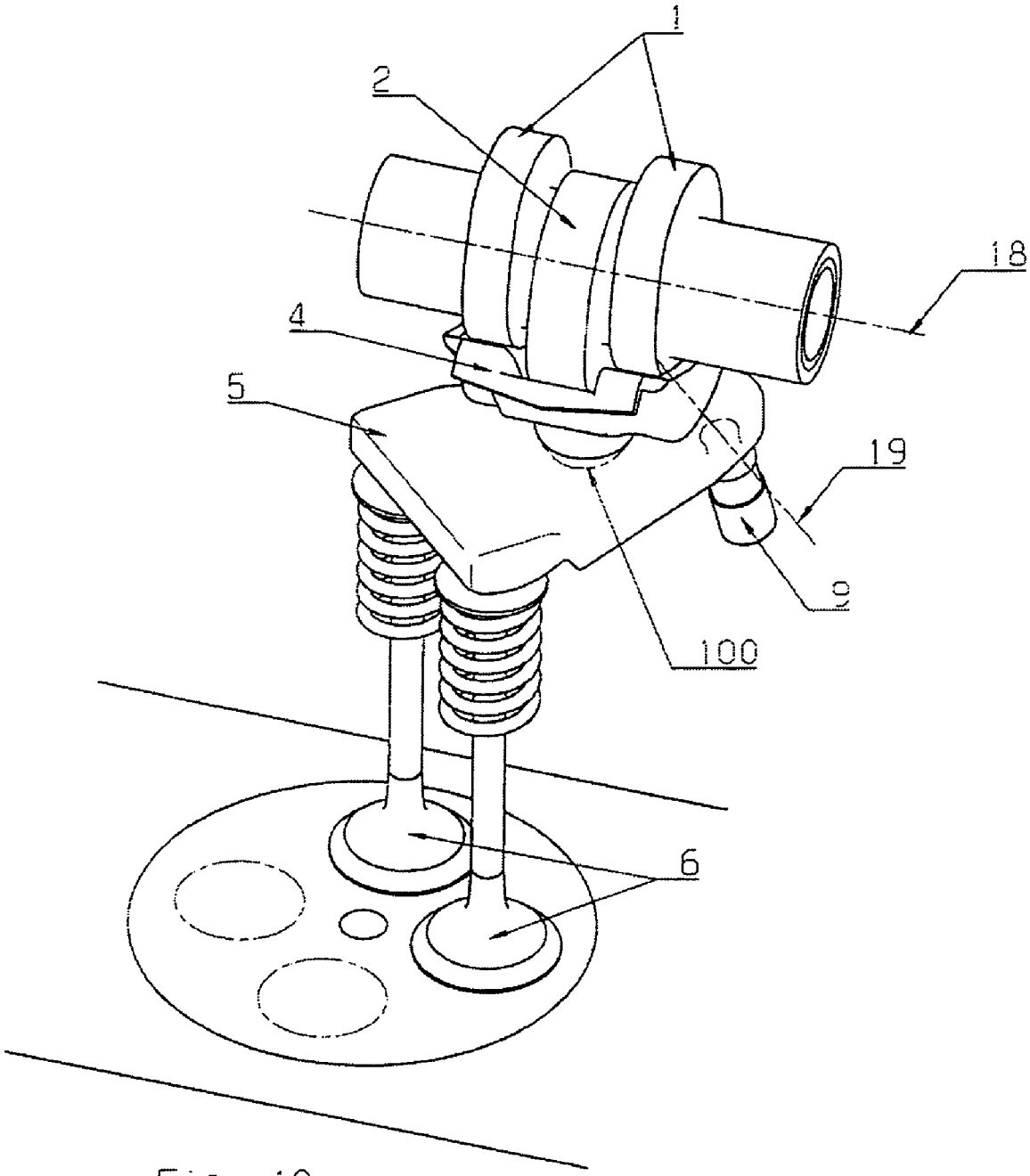
Figure 11:
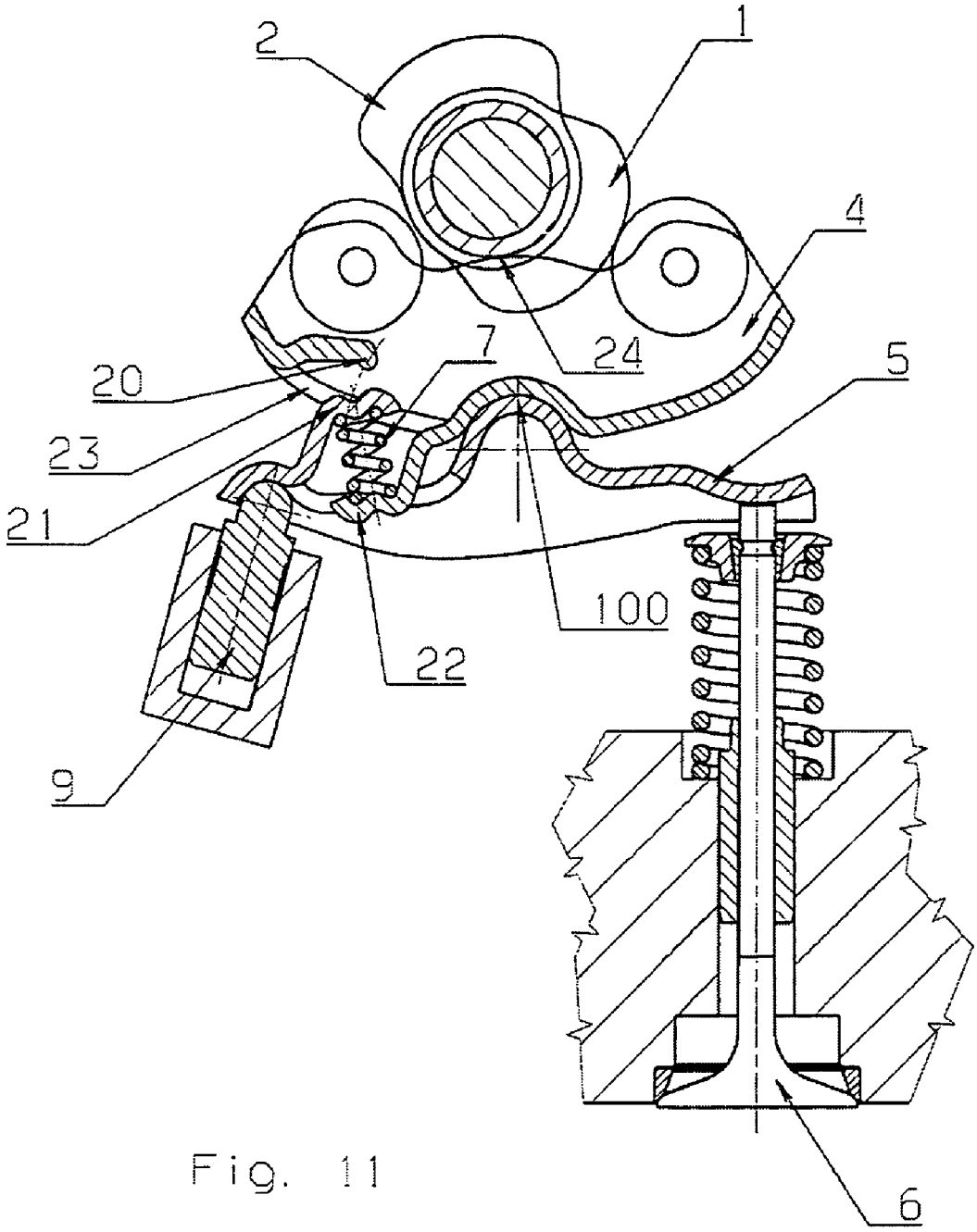

Particularly advantageous and expedient exemplary embodiments are depicted in the drawings, which show (not including FIG. 1, which illustrates the state of the art):

FIG. 1 a variable valve control having two camshafts according to the previously known state of the art according to EP 1 022 443 B1, FIGS. 2, 2A a first basic embodiment of an inventive valve control having three separate cam profiles on three separate camshafts in two different designs, FIG. 3 a second embodiment of the valve control with an adjusting camshaft having three cam profiles in rolling engagement and having an axial bearing of the intermediate element with respect to a lift actuating element of the valve, FIG. 4 a third embodiment of the valve control in which sliding engagement is provided instead of rolling engagement on the cam profiles in comparison with the embodiment according to FIG. 3, and a universal ball joint bearing is provided instead of the axial bearing of the intermediate element, FIG. 4A a section through an area of the valve control according to line IVA-IVA in FIG. 4, FIG. 4B a section through an area of the valve control according to line IVB-IVB in FIG. 4, FIG. 5 an embodiment of the valve control with rolling engagement on the cam profiles according to the basic principle illustrated in FIG. 4 instead of the sliding engagement in FIG. 4, FIG. 5A a section through an area of the valve control according to line VA-VA in FIG. 5, FIG. 5B a section through an area of the valve control according to line VB-VB in FIG. 5, FIG. 5C an alternative embodiment to the variant according to FIG. 5B, FIG. 6 another embodiment of the valve control according to the basic principle as in FIG. 3 with roll engagement on the cam profiles and a linearly displaceable bearing of the intermediate element on the lift actuating element, FIG. 7 a modification of the control device according to FIG. 6 by replacing the rolling engagement on the cam sections with a sliding engagement, FIG. 8 a three-dimensional diagram of the valve control according to FIG. 4, FIG. 9 a three-dimensional diagram of the valve control according to FIG. 7, FIG. 10 a valve control having inventive elements for actuation of a valve pair having a line connecting the midpoints of the openings of the two valves of this pair, said line running at an inclination to a camshaft axis, FIG. 11 a special embodiment of a valve control with inventive elements for actuation of a valve pair in a sectional view as in an embodiment according to FIG. 10, for example.

VALVE CONTROL ACCORDING TO THE STATE OF THE PRIOR ART IN FIG. 1

Two synchronized contrarotating variable-phase camshafts having first and second cam profiles 1 and 2 operate an intermediate element 4 which is designed as a lever having two contact rollers, said intermediate element transmitting the total movement over a bearing axle to a lever which functions as the lift actuating element 5 and actuates a valve 6 via a play compensation device 9. Due to the force of the play compensation device 9, the lift actuating element 5 is pressed against a stop 8 in the zero lift phase. A spring 7 ensures that the intermediate element 4 is always in contact with the contact roller as the first guide area 111 of the intermediate element 4 and the first cam profile 1. In the basic circle phase, there is some play between the second cam profile 2 and the corresponding contact roll as the second guide area 222 of the intermediate element 4. Valve lift is possible only when the two cam profiles 1, 2 are in contact with the intermediate element 4 simultaneously. Valve opening is usually achieved by one of the two camshafts, while the second camshaft must be in the lift position. The closing movement is then achieved by the transition from the lift position to a basic circle phase on the second camshaft with the second cam profile 2. The valve lift and the opening duration can be varied by mutual phase displacement of the two camshafts with the two cam profiles 1, 2.

INVENTIVE EMBODIMENTS

Parts having the same function are labeled with the same reference notation in all the figures of the drawing.

The basic design of the inventive embodiment according to FIG. 2 corresponds to that according to FIG. 1. The most important difference is that the function of the spring 7 in the inventive embodiment is taken over by a third camshaft having a third cam profile 3. This third camshaft 3 produces a forced guidance of the first guide area 111 of the intermediate element 4 while maintaining a continuous contact between the first guide area 111 and the first cam profile 1. The hydraulic play compensation element 9 presses the lift actuating element 5 against an adjustable stop 8. Depending on the position of the individual cam profiles 1 through 3 with respect to another, the valve 6 is actuated via the intermediate element 4 by the two camshafts with the first and/or second cam profiles 1, 2 or the intermediate element 4 is guided in a forced manner between the cam profiles 1 and 3 of the respective camshafts, whereby the lift actuating element 5 and the valve 6 are not moved. There is play in this phase between the camshaft having the second cam profile 2 and the roll as the second guide area 222 on the intermediate element 4.

In an improved variant according to FIG. 2A, in addition to the restoring spring 7 from the state of the art, a stop which is still necessary in the embodiment according to FIG. 2 which conforms to the state of the art may be omitted. This is achieved in the embodiment according to FIG. 2A by arranging the camshaft with the third cam profile 3 on the side of the intermediate element 4 on which the guide area 222 can be contacted jointly with the second cam profile 2. No stop 8 is necessary in this embodiment.

In an embodiment according to FIG. 3, the three cam profiles 1, 2, 3 are arranged concentrically on a common camshaft. To be able to achieve a phase adjustment, the second cam profile 2 is variable in phase with respect to the two other cam profiles 1 and 3 which are fixedly connected to the camshaft. This phase adjustment may be achieved with the design measures conventional for this purpose in the state of the art. For example, a known embodiment consists of mounting the mutually adjustable cam profiles on contrarotating concentric camshafts, to which end the outer camshaft has radial recesses for the cam profiles connected to the shaft on the interior.

In the embodiment according to FIG. 3, the controlling movement of the camshaft is transmitted on the one hand to the intermediate element 4 by the first cam profile 1, which cooperates exclusively with the first guide area 111 of the intermediate element, and via the second and third cam profiles, whereby these two latter cam profiles 2, 3 cooperate exclusively with the second guide area 222 of the intermediate element 4 in alternation. The forced control of the cam profile 1 is given by the design of the third cam profile 3 as a complementary profile to the first cam profile 1. In a phase displacement of the second cam profile 2 with respect to the remainder of the camshaft with the cam profiles 1, 3, a modified movement of the intermediate element 4 is achieved with the cam profiles 1, 3 with respect to the remainder of the camshaft and thus a variation in the valve lift and the opening time for the valve 6 are achieved as well. During a valve opening phase by the cam profiles 1, 2 there is no contact between the third cam profile 3 and the intermediate element 4.

The valve control according to FIG. 4 has a design that is fundamentally comparable to the design according to FIG. 3, but in the embodiment according to FIG. 4, in contrast with that according to FIG. 3, the movement of the cam profiles 1 through 3 is not transferred to the intermediate element 4 by rolling contacts by instead by sliding contacts. This intermediate element 4 is in contact with a lift actuating element 5 via a universal ball joint bearing 100, thereby causing the valve 6 to be actuated. Via the play compensation element 9, the force transmission system consisting of the lift actuating element 5 and the intermediate element 4 is held without play between the first and third cam profiles 1, 3 and the valve 6. The contours of the first and second guide areas 111, 222 of the intermediate element 4 in this embodiment according to FIG. 4 are shown in the sections according to FIGS. 4A and 4B where it can be seen how a very simple and space saving solution is possible due to the arrangement of the cam profiles 1 through 3 and the shape of the intermediate element 4. In FIG. 4A the contact area for the cam profiles 2 and 3 is in an interior section 11 of the intermediate element 5 and is alternately between the second cam profile 2 (a closing cam here) and the divided third cam profile 3 (restoring cam). The divided first cam profile 1 (opening cam here) has enough clearance and does not contact the intermediate element 4 in its second guide area 222.

In FIG. 4B the arrangement is reversed, with the divided cam profile 1 (the opening cam here) actuating the intermediate element 4 in the outer areas 12 and 13, whereby the two cam profiles 2 and 3 do not come in contact with the intermediate element 4.

It can be seen there how a very simple and space-saving solution is possible through the arrangement of the cam profiles 1 and 3 and the shape of the intermediate element 4. In FIG. 4A, the contact area for the cam profiles 2 and 3 is in an inner section 11 of the intermediate element 5 and is alternately between the second cam profile 2 (here the closing cam) and the divided third cam profile 3 (restoring cam). The divided first cam profile 1 (opening cam here) has enough clearance and does not contact the intermediate element 4 it in its second guide area 222.

The arrangement is reversed in FIG. 4B, with the divided cam profile 1 (opening cam here) actuating the intermediate element 4 in the outside areas 12 and 13, whereby the two cam profiles 2 and 3 do not come in contact with the intermediate element 4.

The embodiment according to FIG. 5 corresponds essentially to that according to FIG. 4, except that a rolling engagement is accomplished on the cam profiles 1 through 3, and in addition, the intermediate element 4 is connected to the lift actuating element 5 via an axle bearing 101. The sectional views in FIGS. 5A and 5B show that a roll 14 which is provided in the first guide area 111 of the intermediate element 4 may be alternately in contact with the cam profiles 2 and 3 (not shown here). In the embodiment according to FIG. 5B, it can also be seen how the second guide sections 222 of the intermediate element 4 are designed there as rolls for rolling engagement. The same thing holds for the embodiment according to FIG. 5C. Here only the bearings of the rolls are shaped and/or punched differently out of the material of the intermediate element 4.

FIG. 6 shows a very simple design of a space saving valve control. The intermediate element 4 is in gliding contact with a ram component 10 as a special design of a lift actuating element 5 via an adjusting plate 17 which may be made of ceramic, for example. The bearing of the intermediate element 4 in the direction of the axis of the camshaft with the cam profiles 1 through 3 is achieved by opposing side walls 15 of the intermediate element 4 in that these side walls are in contact with the respective base bodies of the cam profiles 1 through 3 as an abutment. Instead of opposing side walls 15 of the intermediate element 4, the intermediate element 4 may be designed in any interior area with a guide wall which engages between the cam profiles as a opposing bearing.

As an alternative to the adjustment of play via the adjusting plate 17, rams having different thicknesses may also be used for adjusting the play.

In the embodiment according to FIG. 7, rolling engagement on the cam profiles 1 through 3 is replaced by a sliding engagement. The adjustment plate 17 as a lift actuating element 5 is arranged directly between the valve 6 and the intermediate element 4. The ram 10, which functions only as a guide element, is held without play on the adjustment plate 17 by an additional elastic support 16.

FIG. 10 illustrates a valve control having inventive elements for actuation of a valve pair with a swivel axis 19 of the lift transmitting element 5, which runs at an inclination to a camshaft axis. This valve arrangement is referred to below as "axially twisted." Such a valve control may be accomplished through a transmission device which consists of an intermediate element 4 according to one of the embodiments shown in FIGS. 4, 5 and in particular FIG. 8, and a lift actuating element 5 according to FIG. 8, for example. In the embodiment according to FIG. 8 a "third cam profile 3" is also present on the common camshaft according to this invention, but such a cam profile may essentially be omitted in an application with "axially twisted" valves with respect to the advantages of such a device when using it with "axially twisted" valves, as in the embodiment shown in FIG. 10. In the absence of the inventive "third cam profile 3," a spring 7 is necessary in the sense of the state of the art according to FIG. 1, this spring being situated between the camshaft and the valves to ensure constant contact of the intermediate element 4 with a cam profile 1, 2 within the transmission device. This spring 7 is present in the device according to FIG. 10 but is not discernible because it is situated behind the intermediate element 4 in the drawing. The crucial factor for the function of the device according to FIG. 10 is a universal ball joint bearing 100 between the intermediate element 4 and the lift actuating element 5. Only through this type of bearing can the actuating forces be transmitted from a camshaft to "axially twisted" valves. In the extreme case, the directional deviation may amount to as much as 90°. Due to the universal ball joint bearing 100, the tilting movement of the intermediate element 4 may be compensated with no problem on the basis of the cam actuation, like the relative movement in the valve lifting on the basis of the different directions of the axes 18 of the camshaft and the pivot axis 19 of the intermediate element 4 together with the lift actuating element 5. In the embodiment according to FIG. 10 despite the different axes 18 and 19, the valve bridge which is otherwise customary with such an "axially twisted" alignment may be omitted despite the different axles 18 and 19.

The embodiment according to FIG. 11 has essentially the same design with regard to the intermediate element 4 and the lift actuating element 5 as the embodiment according to FIG. 10. In particular, the spring 7 (which is required in the absence of the inventive "third cam profile" according to the previously known state of the art—the depiction of this spring has been omitted from FIG. 10) is shown in a special form of a bearing in FIG. 11 in particular. This bearing is accomplished via such abutments 21 and/or 22 which are shaped into the intermediate element 4 and the lift actuating element 5 that these two parts 4, 5, in a state in which they have not yet been installed in the control, form a portable composite in which they can be installed into the control.

The shaping of the abutments 21, 22 may be based in particular on the intermediate element 4 such that an axial guidance of the intermediate element 4 with respect to the axial side walls is achieved for the intermediate element 4 through the abutment 21 with respect to the axial side walls 20 of a slot 23.

In the embodiment according to FIG. 11, a stop 24 is provided on the intermediate element 4 as a contact area which is shaped concentrically with the axis of rotation of the intermediate element 4 in the sense of the stop 8 according to the embodiment in FIGS. 1 and 2 in order to be able to provide an automatic valve play compensation 9, in particular in the absence of a "third cam profile."

In the embodiments according to FIGS. 10 and 11, the first and second cam profiles 1 and 2 may be mutually phase-variable. At this point it should be emphasized explicitly again that the embodiments in which the "third cam profile" are missing according to FIGS. 10 and 11 are only a generalization of the inventive embodiment with the "third cam profile" according to FIG. 8 in particular to show the advantages essentially achievable in an "axially twisted"

valve arrangement with a camshaft having first and second cam profiles in the sense of this invention through the use of an intermediate element 4 which is connected by a universal ball joint bearing 100 to a lift actuating element 5.

All the function principles depicted here are given only as examples and may also be combined in any desired manner. The valve control principle according to this invention is preferably usable for actuation of one or more valves with a cam package.

The invention claimed is:

1. A valve control for actuation of at least one valve (6), of an internal combustion engine, in which the measure of the valve lift of the at least one valve (6) corresponds to superimposing two cam profiles (1, 2) moving in synchronization, one of these two cam profiles (1; 2) determines mainly the valve opening range and the other cam profile (2; 1) determines mainly the valve closing range, the two cam profiles (1, 2) are mutually phase-variable, the valve lift period and the opening period of the at least one valve (6) can be varied through the phase displacement, the two cam profiles (1; 2) determine the valve lift via an intermediate element (4) acting on a lift actuating element (5) of the valve (6), intermediate element (4), namely a first guide area (111) comes in contact with a first of the two cam profiles (1) in all rotational positions, whereas this is not the case with the second cam profile (2) with respect to the second guide area (222) at least in a partial area of the basic circular area of this second cam profile (2), constant contact of the first guide area (111) of the intermediate element (4) on the first cam profile (1) is given by a guide means, wherein the guide means is designed as a third cam profile (3) which rotates in synchronization with the first cam profile (1) and has a complementary shape in comparison with the first cam profile (1).

2. The valve control according to claim 1, wherein all three cam profiles (1, 2, 3) are arranged so they are concentric on a basic circle on a common adjusting camshaft.

3. The valve control according to claim 2, wherein only the second cam profile (2) is phase variable.

4. The valve control according to claim 2, wherein the intermediate element (4) surrounds the camshaft with the cam profiles (1 through 3) from the outside in a V-shape with first and second guide areas (111, 222) which are provided on the ends, whereby the first cam profile (1) is constantly in contact only with the first guide area (111) and the second and third cam profiles are in contact exclusively with the second guide area (222) in alternation with one another.

5. The valve control according to claim 2, wherein only a single second guide area (222) is provided for alternating guidance of the second and third cam profiles (2, 3).

6. The valve control according to claim 2, wherein the intermediate element (4) is mounted to be linearly displaceable with respect to the lift actuating element (5).

7. The valve control according to claim 2, wherein the intermediate element (4) is mounted so that it is pivotable about an axis with respect to the lift actuating element (5).

8. The valve control according to claim 2, wherein the intermediate element (4) is connected to the lift actuating element (5) via a universal ball joint bearing (100).

9. The valve control according to claim 2, wherein at least the base body of one of the cam profiles (1 through 3) is designed as an axial guide bearing which serves for the intermediate element (4) in the direction of the axis of rotation of the cam profiles (1 through 3).

10. The valve control according to claim 2, wherein at least one of the cam profiles (1 through 3) is designed in two parts in the form of two narrow cam webs at a certain distance.

11. The valve control according to claim 10, wherein at least one of the other cam profiles (1 through 3) is arranged between the two narrow cam webs.

12. The valve control according to claim 2, wherein the intermediate element (4) is a lever shaped out of sheet metal and designed in the form of a W and/or stair steps as seen in cross section in order to ensure clearance for the cam profiles (1 through 3) which are not in engagement in addition to ensuring the required stiffness.

13. The valve control according to claim 1, wherein a hydraulic valve compensating element (9) cooperates with the life actuation element (5) of the valve (6) for compensation of play.

* * * * *